United States Patent [19]

Tamaki

[11] Patent Number: 4,580,701

[45] Date of Patent: Apr. 8, 1986

[54] AUTOMATIC CLOSURE NOZZLE FOR COLLAPSIBLE CONTAINERS

[76] Inventor: Hitoshi Tamaki, 1501 W. 19th St., Long Beach, Calif. 90810

[21] Appl. No.: 643,155

[22] Filed: Aug. 22, 1984

Related U.S. Application Data

[63] Continuation-in-part of Ser. No. 382,636, May 21, 1982, abandoned.

[51] Int. Cl.[4] ..... B65D 35/46

[52] U.S. Cl. ..... 222/92; 222/494

[58] Field of Search ..... 222/494, 490, 513, 92, 222/517, 212, 107, 545, 406, 407, 498

[56] References Cited

U.S. PATENT DOCUMENTS 1,989,145 1/1935 Newby ..... 222/498

2,730,274 1/1956 Brown ..... 222/490

*Primary Examiner*—Stanley H. Tollberg

*Attorney, Agent, or Firm*—Albert O. Cota

[57] ABSTRACT

An automatic closure nozzle for a collapsible container is disclosed herein which opens to discharge the contents of the container when squeezed and which closes to seal the contents upon cessation of squeeze pressure. The inventive concept is particularly useful in connection with containers holding toothpaste, cosmetics, food products and a variety of liquid and semi-liquid products. The inventive concept includes a self sealing nozzle for a squeeze-type container composed of a pliable material which includes a flexible cap portion terminating at one end so as to define a discharge opening therein. The cap portion hingably mounts an inner and an outer seals, both of which have a plurality of stiff, triangularly shaped sections and coaxially disposed in spaced apart relationship. Each section in the respective inner and outer seals overlap to form a sealed closure in a first position and fully open in a second position to permit discharge of container contents through the discharge opening. An extension spring is attached between the container at one end and the cap portion on the other whereby expansion of the sidewall under squeeze pressure actuates the seals to their second position and release of pressure contracts the spring to return the seals to their first position.

3 Claims, 13 Drawing Figures

AUTOMATIC CLOSURE NOZZLE FOR COLLAPSIBLE CONTAINERS

CROSS REFERENCE TO RELATED APPLICATION

This is a continuation-in-part of application Ser. No. 382,636 filed May 21, 1982, now abandoned.

TECHNICAL FIELD

This invention pertains to self-closing caps for squeeze-type containers from which the contents is extruded by the application of pressure on the body of the container and in which a pair of coaxially disposed seals open to discharge the contents when pressure is applied and which close under spring retension when squeeze pressure is removed from the container.

BACKGROUND ART

In the past, closure caps have been employed for collapsible containers utilized for storing extrudible pasty materials such as for example toothpaste, ointments, beauty creams, food product spreads and the like. Such containers usually comprise an extrusion nozzle, having been provided with a screw-on closure cap of solid composition whereby said cap has had to be removed every time it was desired to discharge the contents from the container. Besides being troublesome, this circumstance frequently led to the loss of the closure cap so that in many cases, the container with its contents had to be discarded, or at least, there existed the danger of an undesired extruded portion of the contents taking place by inadvertant compression of the unclosed or uncapped container.

Attempts have been made to overcome this difficulty and problem by providing a closure cap or means for collapsible containers of the kind described which cap may be kept permanently on the container nozzle and yet permit immediate extrusion of the contents. Such prior attempts are disclosed in U.S. Pat. Nos. 4,148,420; 3,506,163 and 2,758,755. Although these prior closure means have been somewhat successful, problems and difficulties often occur which largely stem from the fact that self-sealing of the discharge orifice is unsatisfactory and often times, the extrusion pressure continues after the direct application of pressure to the collapsible tube has been removed so that the contents continues to extrude through the discharge orifice. In other instances, the prior art devices do not adequately cut or sever the extruded portion of the contents from the unextruded position remaining in the tube so that contamination and wastage of contents is encountered.

Therefore, a long standing need has existed to provide a novel closure means for a collapsible container which is an integral part of the container and which will readily dispense the contents thereof in an extruded manner without encountering the above enumerated problems.

DISCLOSURE OF THE INVENTION

The automatic closure nozzle disclosed herein comprises a self sealing nozzle carried on a collapsible or squeezed-type container composed of a mouldable material so that when deformed, the deforming pressure forces the contents to extrude from the nozzle in a continuous stream as long as pressure is applied. Upon the release of pressure, the nozzle is closed and extrusion ceases. The nozzle includes a flexible cap portion terminating at one end so as to define a discharge opening which is sealed by an inner and an outer seal, both of which include a plurality of stiff, triangularly shaped sections coaxially disposed in spaced apart relationship. An extension spring is operably disposed between the container at one of its ends and to the flexible cap portion at its other end. Squeeze pressure on the collapsible tube causes the extension spring to expand which actuates the seals from their closed position to an open position for releasing the contents of the tube through the discharge orifice. Upon release of the pressure, the contraction of the extension spring causes the inner and outer seals to return to their closed and sealing position.

In this manner, the present invention avoids the above enumerated problems and difficulties in that the closure means is self sealing after discharge of a desired amount of contents and the closure means as well as its attendant resilient actuator is integrally formed with and carried on the container so that the need for a separate closure means is obviated.

Therefore, it is among the primary objects of the present invention to provide a novel closure means for collapsible or deformable containers which may be kept permanently on the container and yet will automatically permit discharge of the contents and will seal off the contents automaticaly upon release of pressure to the container.

Another object of the present invention is to provide a novel closure means for a deformable or mouldable container which will effectively extrude the contents therefrom through an integral nozzle which includes closure means for nipping off the extruded portion of the contents and sealing the remainder of the contents from the discharge orifice.

Yet another object of the present invention is to provide a novel closure means for a squeeze type container which is integral with the container and which is reliable, easily maintained and which is not a separate unit requiring it to be removed before discharge of the contents.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

BEST MODE FOR CARRYING OUT THE INVENTION

Figure 1:
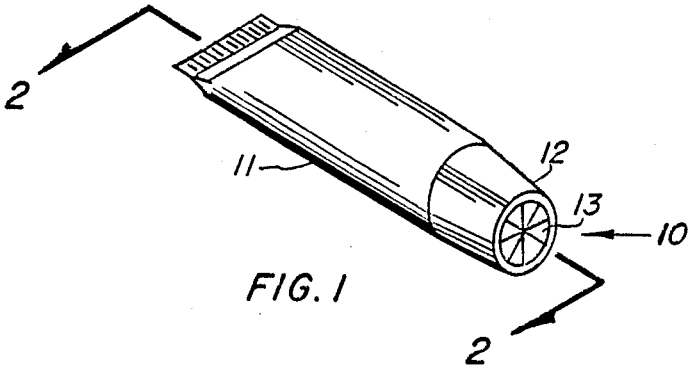
FIG. 1 is a front perspective view of a typical squeeze type or collapsible container incorporating the novel integral automatic closure nozzle of the present invention.

Referring to FIG. 1, the novel automatic closure nozzle of the present invention is shown in the general direction of arrow 10 which is illustrated attached to a collapsible container 11 holding a quantity of paste-like material such as toothpaste, ointments or the like. The closure nozzle 10 includes a flexible cap portion 12 which is suitably mounted or carried on the end of tube 11 by any suitable means and further includes an outer seal identified in general by the numeral 13.

Figure 2B:
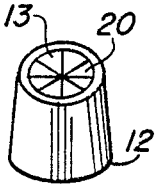
FIG. 2*b* is a perspective view of the closure nozzle shown in FIGS. 1 and 2*a* illustrating the closure nozzle in its sealed condition.
Figure 2A:
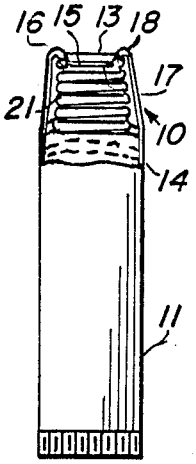
FIG. 2*a* is a longitudinal cross sectional view of the novel closure nozzle and container shown in FIG. 1 as taken in the direction of arrows 2—2 thereof.

As shown more clearly in FIG. 2*a* and FIG. 2*b*, the tube 11 includes contents as previously described illustrated by numeral 14. The cap portion 12 not only includes the outer seal 13 but an inner seal 15 as well. The nozzle 10 is of a self sealing nature for the squeeze-type container 11 and the cap portion 12 includes a cylindrical sidewall having one end carried on the end of tube 11 while its opposite end is reversed or folded inward upon itself about a hinge area 16 of reduced thickness so that its extreme edge 17 is coaxially disposed with respect to the cylinder wall. A discharge wall portion extending between the hinge or reduced area 16 and the edge 17 is identified by numeral 18 and this wall mounts the inner and outer seals 15 and 13 respectively.

As shown in FIG. 2*b*, the outer seal 13 comprises a plurality of stiff, triangularly shaped sections such are suitably attached to the wall 18 and the inner and outer seals are arranged in fixed spaced apart relationship so as to form a double seal in cooperation with each other.

It is to be particularly noted that each section in the respective inner and outer seals overlaps to form a sealed closure in a first position and fully open in a second position to permit discharge of container contents through the discharge opening defined by the discharge orifice or circular edge 17 of the wall 18. A resilient extension spring 21 connects the discharge wall 18 to the inside of the container 11. As this spring 21 is normally biased in compression, the wall 18 is pulled downwardly in the direction of container tube 11 so that the sections of the seals are tightly engaged in closure to prevent escape or leakage of the tube contents 14. However, under squeeze pressure of tube 11, the extension spring 21 is urged into expansion so as to open the inner and outer seals to permit discharge of the contents 14. The spring may be of any suitable material for the application such as thermoplastic or metal with stainless steel being preferred.

Figure 3B:
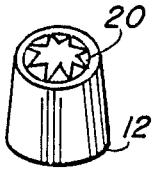
FIG. 3*b* is a view similar to the view shown in FIG. 2*b* illustrating the first or outer seal partially open corresponding to the condition shown in FIG. 3*a;*
Figure 3A:
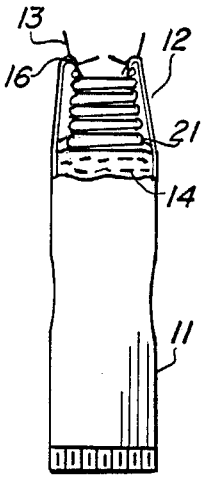
FIG. 3*a* is a diagrammatic view in section of the container and closure nozzle similar to the view shown in FIG. 2*a* and illustrating the commencement of pressure to the collapsible tube so as to open the first or outer seal of the closure nozzle.

Initial pressure placed on the tube 11 illustrates expansion of the spring 21 in FIG. 3*a* so that the sections of the outer seal 13 spread apart as the flexible wall of the cap portion 12 expands and the wall 18 pivots about the hinge or reduced portion 16. In FIG. 3*b*, the sections 20 of the outer seal 13 are illustrated partially expanded to an open condition.

Figure 4B:
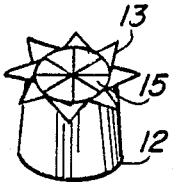
FIG. 4*b* is a view similar to the views shown in FIGS. 2*b* and 3*b* illustrating the full open condition to the outer seal and the partially open condition of the inner seal in accordance with the view 4*a;*
Figure 4A:
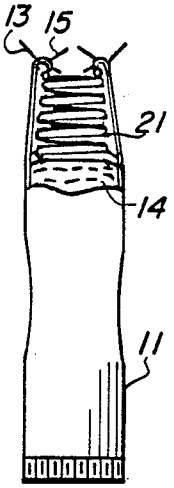
FIG. 4*a* is a view similar to the view shown in FIG. 3*a* illustrating further pressure being applied so that the contents expands the resilient means to fully open the outer seal and partially open the inner seal of the closure nozzle.

Referring now to FIG. 4*a*, the pressure on the tube 11 has increased to the point where the extension spring 21 is almost fully expanded and the outer seal 13 is almost in its fully open position and that the inner seal 15 is now partially open. In FIG. 4*b*, it can be seen that the seals are coaxially disposed with respect to each other and that once the outer seal is substantially open, the inner seal 15 begins to open.

Figure 5B:
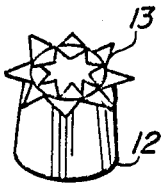
FIG. 5*b* is a view similar to the view of FIG. 4*b* illustrating the outer and inner sealing means fully opened in accordance with the view of FIG. 5*a* when fully pressure has been applied to the container.
Figure 5A:
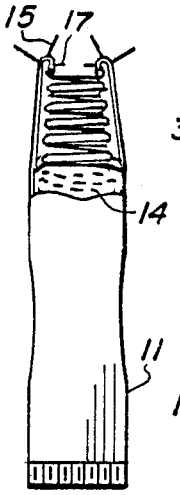
FIG. 5*a* is a view similar to the view of FIG. 4*a* illustrating the outer and inner seals fully open.

As shown in FIG. 5*a*, the outer seal 13 is now fully open and the inner seal 15 is fully open so that the contents 14 may be extruded through the discharge orifice represented by the edge 17. The extension spring has been fully expanded against its normal bias because of the overpowering force or pressure of the contents as the tube is squeezed. FIG. 5*b* shows the open condition of both seals so that the product or contents may be dispensed therefrom.

Figure 6B:
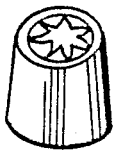
FIG. 6*b* shows the top of FIG. 6*a;*
Figure 6A:
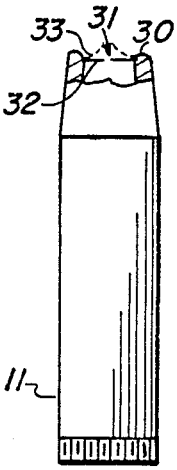
FIG. 6*a* is a front elevational view of another embodiment of the present invention illustrating a single sealing means associated with the closure nozzle incorporating the present invention.
Figure 7:
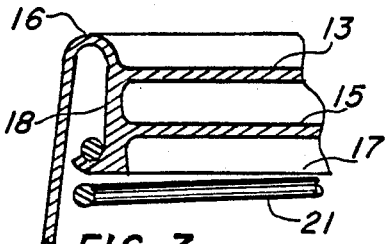
FIG. 7 is an enlarged partial cross sectional view as shown in FIG. 2*a* illustrating the closed nozzle in its sealed condition.
Figure 8:
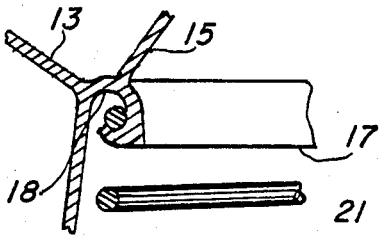
FIG. 8 is an enlarged partial cross sectional view as shown in FIG. 5*a* illustrating the outer and inner seals fully open.

Referring now in detail to FIG. 6, another embodiment of the present invention is illustrated which includes a cap 30 having a discharge orifice illustrated in the general direction of arrow 31 which is sealed by a closure means 32. The closure means 32 is identical to the outer seal 13 associated with embodiment 10. However, the closure or sealing means 32 includes a plurality of triangular sections such as section 33 which are hingably carried at the discharge orifice 31 of the cap 30 so that when pressure is applied to the underside of the sections, the sections will expand or move to the position shown in broken lines so that the contents may be discharged or extruded from the cap via the orifice 31.

Therefore, it can be seen that the novel closure nozzle for collapsible containers is easy to use and will readily dispense or extrude a product contained in the tube or container 11. Opening of the closure or seals 13 and 15 is achieved by squeeze pressure on the tube or container 11 so that the contents 14 will cause the expansion of spring 21 against its normal bias and force the opening of the sections associated with the seals. The flexible cap portion 12 will expand accordingly to accommodate opening of the seals. Therefore, expansion of the spring under squeeze pressure actuates the seals or closures to their open position and release of the pressure contracts the spring via its self bias to return the seals to their closed position. While returning to the closed position, the edges of the sections associated with each of the seals will nip or cut a portion of the extruded product so that a clean cut of the material being dispensed is made. In this manner, no overage or residue is encountered. In the embodiment shown in FIG. 6, the sections 33 expand under squeeze pressure and upon the release of the pressure, the sections 33 will reverse to their closed position under their normal bias to the position shown in solid lines. The extruded product will be cut or severed accordingly and no overage or undesired material will be left outside the closure.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

I claim:

1. A closure apparatus for collapsible containers comprising:

a. a container of pliable material for holding a quantity of paste-like material;

b. a flexible cap portion carried on one end of said container in communication said paste-like material, said flexible cap portion joins with said discharge portion with a reduced wall thickness so as to allow said discharge portion to fold over inside said flexible cap portion;

c. said cap portion having a discharge portion folded over upon itself to terminate in a dispensing orifice;

d. sealing means operably carried on said discharge portion adapted to move between a closed position for sealing said paste-like material in said container and an open position for conducting said paste-like material for discharge via said discharge orifice;

said sealing means comprises a first and a second set of sealing elements arranged in spaced apart, coaxial relationship; and, e. resilient means attached to said container at one end and to said discharge portion at its other end for normally biasing said discharge portion to be folded so as to maintain said sealing means in its closed position, said resilient means is attached by its one end to said discharge portion mid-way between said first and said second set of sealing elements.

2. A closure apparatus for collapsible containers comprising:

a. a container of pliable material for holding a quantity of paste-like material;

b. a flexible cap portion carried on one end of said container in communication said paste-like material, said flexible cap portion joins with said discharge portion with a reduced wall thickness so as to allow said discharge portion to fold over inside said flexible cap portion;

c. said cap portion having a discharge portion folded over upon itself to terminate in a dispensing orifice;

d. sealing means operably carried on said discharge portion adapted to move between a closed position for sealing said paste-like material in said container and an open position for conducting said paste-like material for discharge via said discharge orifice; said sealing means comprises a first and a second set of sealing elements arranged in spaced apart, coaxial relationship, each of said sealing sets of elements comprise a plurality of stiff, triangular elements attached to said flexible cap portion so that their adjacent edges overlap when in said sealing means closed position, said elements of each set adapted to sequentially radiate outwardly to said open position in response to squeeze pressure applied to said container whereby said paste-like material forciably urges said flexible cap portion to unfold said discharge portion; and, e. resilient means attached to said container at one end and to said discharge portion at its other end for normally biasing said discharge portion to be folded so as to maintain said sealing means in its closed position, said resilient means is attached by its one end to said discharge portion mid-way between said first and said second set of sealing elements.

3. A closure apparatus for collapsible containers comprising:

a. a container of pliable material for holding a quantity of paste-like material;

b. a flexible cap portion carried on one end of said container in communication said paste-like material, said flexible cap portion joins with said discharge portion with a reduced wall thickness so as to allow said discharge portion to fold over inside said flexible cap portion;

c. said cap portion having a discharge portion folded over upon itself to terminate in a dispensing orifice;

d. sealing means operably carried on said discharge portion adapted to move between a closed position for sealing said paste-like material in said container and an open position for conducting said paste-like material for discharge via said discharge via said discharge orifice; said sealing means comprises a first and a second set of sealing elements arranged in spaced apart, coaxial relationship, each of said sealing sets of elements comprise a plurality of stiff, triangular elements attached to said flexible cap portion so that their adjacent edges overlap when in said sealing means closed position, said elements of each set adapted to sequentially radiate outwardly to said open position in response to squeeze pressure applied to said container whereby said paste-like material forciably urges said flexible cap portion to unfold said discharge portion; and, e. resilient means attached to said container at one end and to said discharge portion at its other end for normally biasing said discharge portion to be folded so as to maintain said sealing means in its closed position, said resilient means is attached by its one end to said discharge portion mid-way between said first and said second set of sealing elements;

said resilient means is an extension spring mounted in contraction so as to normally bias said flexible cap portion to fold said discharge portion to place said sealing means in their respective closed position.

* * * * *